US010917714B2

(12) United States Patent
Hong et al.

(10) Patent No.: US 10,917,714 B2
(45) Date of Patent: Feb. 9, 2021

(54) SPATIAL AUDIO RECORDING DEVICE, SPATIAL AUDIO RECORDING METHOD, AND ELECTRONIC APPARATUS INCLUDING SPATIAL AUDIO RECORDING DEVICE

(71) Applicant: SAMSUNG ELECTRONICS CO., LTD., Suwon-si (KR)

(72) Inventors: Hyeokki Hong, Suwon-si (KR); Sungchan Kang, Hwaseong-si (KR); Cheheung Kim, Yongin-si (KR); Yongseop Yoon, Seoul (KR); Choongho Rhee, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/404,020

(22) Filed: May 6, 2019

(65) Prior Publication Data

US 2020/0204910 A1 Jun. 25, 2020

(30) Foreign Application Priority Data

Dec. 20, 2018 (KR) ..... 10-2018-0166605

(51) Int. Cl.
*H04R 1/00* (2006.01)
*H04R 3/00* (2006.01)
(Continued)

(52) U.S. Cl.
CPC ..... *H04R 1/326* (2013.01); *H04R 3/04* (2013.01); *H04S 2400/11* (2013.01); *H04S 2420/01* (2013.01)

(58) Field of Classification Search
CPC ... H04R 1/00; H04R 1/02; H04R 1/08; H04R 1/20; H04R 1/32; H04R 1/323;
(Continued)

(56) References Cited

U.S. PATENT DOCUMENTS 5,193,117 A * 3/1993 Ono ..... H04R 3/005 381/92
5,471,538 A * 11/1995 Sasaki ..... H04R 3/005 381/91
(Continued)

FOREIGN PATENT DOCUMENTS

JP 1994-031837 Y2 8/1994
JP 2010057167 A * 3/2010
(Continued)

OTHER PUBLICATIONS

Brown, Eric. "Matrix Voice RPi Add-on with FPGA-Driven Mic Array Relaunches." LinuxGizmos.com, Jan. 22, 2018, linuxgizmos.com/matrix-voice-rpi-add-on-with-7-mic-array-relaunches/.
(Continued)

*Primary Examiner* — Thang V Tran
(74) *Attorney, Agent, or Firm* — Sughrue Mion, PLLC

(57) ABSTRACT

A spatial audio recording device includes: a plurality of directional vibrating bodies arranged such that at least one of the plurality of directional vibrating bodies selectively reacts according to a direction of input audio; a non-directional vibrating body configured to react regardless of the direction of the input audio; a read-out circuit configured to output a directional audio signal including a plurality of channels based on reactions of the directional vibrating bodies and a non-directional audio signal based on a reaction of the non-directional vibrating body; and a processor configured to correct the directional audio signal based on the non-directional audio signal.

21 Claims, 11 Drawing Sheets

(51) Int. Cl.
*H04R 1/32* (2006.01)
*H04R 3/04* (2006.01)

(58) Field of Classification Search
CPC ..... H04R 1/326; H04R 3/00; H04R 3/005; H04R 3/04; H04R 3/12; H04S 2400/01; H04S 2400/11; H04S 2420/01; G10L 2021/02165
See application file for complete search history.

(56) References Cited

U.S. PATENT DOCUMENTS

| | | | | |
|---|---|---|---|---|
| 9,924,264 | B2 | 3/2018 | Yoshino | |
| 2012/0140948 | A1* | 6/2012 | Terada | H04R 29/006 381/92 |
| 2012/0257779 | A1* | 10/2012 | Kimura | H04N 5/225 381/359 |
| 2015/0281834 | A1* | 10/2015 | Takano | H04R 1/08 381/92 |
| 2016/0157011 | A1* | 6/2016 | Yoo | H04R 3/00 381/357 |
| 2017/0013355 | A1* | 1/2017 | Kim | H04R 1/406 |
| 2019/0072635 | A1* | 3/2019 | Kang | G10K 11/1781 |
| 2019/0174244 | A1* | 6/2019 | Kim | H04R 5/04 |
| 2019/0387285 | A1 | 12/2019 | Ferren | |
| 2020/0068302 | A1 | 2/2020 | Kang | |

FOREIGN PATENT DOCUMENTS

| | | | |
|---|---|---|---|
| JP | 2012-104905 | A | 5/2012 |
| JP | 2017-028603 | A | 2/2017 |
| KR | 10-1521363 | B1 | 5/2015 |

OTHER PUBLICATIONS

"Vocal Technologies." Vocal.com, www.vocal.com/beamforming-2/acoustic-source-localization-using-circular-array-microphones/.

Williams , Michael. "The 'Williams Star' Surround Microphone Array." Posthorn, 91st Audio Engineering Society Convention in New York, Oct. 1991, www.posthorn.com/Micarray_williamsstar.html.

* cited by examiner

SPATIAL AUDIO RECORDING DEVICE, SPATIAL AUDIO RECORDING METHOD, AND ELECTRONIC APPARATUS INCLUDING SPATIAL AUDIO RECORDING DEVICE

CROSS-REFERENCE TO RELATED APPLICATION

This application is based on and claims priority under 35 U.S.C. § 119 to Korean Patent Application No. 10-2018-0166605, filed on Dec. 20, 2018, in the Korean Intellectual Property Office, the disclosure of which is incorporated herein in its entirety by reference.

BACKGROUND

1. Field

The disclosure relates to spatial audio recording devices, spatial audio recording methods, and electronic apparatuses including spatial audio recording devices.

2. Description of the Related Art

Use of sensors that are mounted on household appliances, image display apparatuses, virtual reality (VR) apparatuses, augmented reality (AR) apparatuses, artificial intelligence speakers, etc. and that are capable of detecting a direction where audio comes from and recognizing voice has increased.

Sensors for detecting audio direction generally calculate a direction where audio comes from by using a time difference of audio reaching a plurality of non-directional microphones. Such a structure requires a sufficient distance between the plurality of microphones for high-quality and high-resolution audio sensing and requires a huge system size and a lot of power consumption.

SUMMARY

The disclosure relates to spatial audio recording devices and methods capable of efficiently sensing spatial audio.

Additional aspects will be set forth in part in the description which follows and, in part, will be apparent from the description, or may be learned by practice of the presented embodiments.

In accordance with an aspect of the disclosure, a spatial audio recording device includes a plurality of directional vibrating bodies arranged such that at least one directional vibrating body from among the plurality of directional vibrating bodies selectively reacts according to a direction of input audio; a non-directional vibrating body configured to react regardless of the direction of the input audio; a read-out circuit configured to output a directional audio signal including a plurality of channels based on reactions of the plurality of directional vibrating bodies and a non-directional audio signal based on a reaction of the non-directional vibrating body; and a processor configured to correct the directional audio signal based on the non-directional audio signal.

A resolution of the plurality of directional vibrating bodies may be lower than a resolution of the non-directional vibrating body.

The processor may be further configured to select a first channel from among the plurality of channels; form an intermediate correction signal by removing a directional audio signal of at least one second channel from the non-directional audio signal; compute a ratio of signal powers of frequency bands of a directional audio signal of the first channel; and form a final correction signal by adding or deducting signal power for each frequency band of the intermediate correction signal to correspond to the computed ratio.

The at least one second channel may include a plurality of second channels, and the processor may be further configured to form the intermediate correction signal by removing every directional audio signal of the plurality of second channels from the non-directional audio signal.

The directional audio signal of the at least one second channel may include a major component including frequency bands having different signal powers and a minor component including frequency bands having a same signal power, and the processor may be further configured to form the intermediate correction signal by removing the major component from the non-directional audio signal.

The directional audio signal of the first channel may include a major component including frequency bands having different signal powers and a minor component including frequency bands having a same signal power, and the processor may be further configured to form the final correction signal by adding or deducting respective signal powers of frequency bands of the major component to correspond to the computed ratio.

The processor may be further configured to decrease signal power of the minor frequency band by half to form the final correction signal.

For each channel from among the plurality of channels, the processor may be further configured to form an intermediate correction signal by removing a directional audio signal of at least one other channel from the non-directional audio signal; compute a ratio of signal powers of frequency bands of a directional audio signal of the respective channel; and form a final correction signal by adding or deducting signal power for each frequency band of the intermediate correction signal according to the ratio.

The plurality of directional vibrating bodies may be arranged on a same plane to surround a central point on the plane, and a center of the non-directional vibrating body may be located directly above the central point in a direction perpendicular to the plane.

The plurality of directional vibrating bodies may be arranged on a plurality of planes, each plane from among the plurality of planes being located at a same distance from the non-directional vibrating body.

The plurality of planes may include a first plane and a second plane parallel to each other.

The plurality of planes may further include a third plane and a fourth plane perpendicular to the first plane and the second plane, the third plane and the fourth plane being parallel to each other.

The plurality of planes may further include a fifth plane and a sixth plane perpendicular to the first plane, the second plane, the third plane, and the fourth plane, the fifth plane and the sixth plane being parallel to each other.

An electronic apparatus may include the spatial audio recording device in accordance with the above-noted aspect of the disclosure.

The electronic apparatus may further include a multichannel speaker configured to reproduce a corrected audio signal based on the corrected directional audio signal.

The electronic apparatus may further include an omnidirectional imaging module configured to capture an image in a plurality of directions corresponding to the plurality of channels.

In accordance with an aspect of the disclosure, a spatial audio recording method includes receiving a directional audio signal including a plurality of channels from a plurality of directional vibrating bodies arranged such that at least one directional vibrating body from among the plurality of directional vibrating bodies selectively reacts according to a direction of the input audio; receiving a non-directional audio signal from a non-directional vibrating body configured to react regardless of the direction of the input audio; and correcting the directional audio signal based on the non-directional audio signal.

The correcting the directional audio signal may include selecting a first channel from among the plurality of channels; forming an intermediate correction signal by removing a directional audio signal of at least one second channel from the non-directional audio signal; computing a ratio of signal powers of frequency bands of a directional audio signal of the first channel; and forming a final correction signal by adding or deducting signal power for each frequency band of the intermediate correction signal to correspond to the ratio.

The at least one second channel may include a plurality of second channels, and the forming the intermediate correction signal may include removing every directional audio signal of the plurality of second channels from the non-directional audio signal.

The directional audio signal of the at least one second channel may include a major component including frequency bands having different signal powers and a minor component including frequency bands having a same signal power, and the forming of the intermediate correction signal may include removing the major component from the non-directional audio signal.

The directional audio signal of the first channel may include a major component including frequency bands having different signal powers and a minor component including frequency bands having a same signal power, and the forming of the final correction signal may include adding or deducting respective signal powers of frequency bands of the major component to correspond to the computed ratio.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
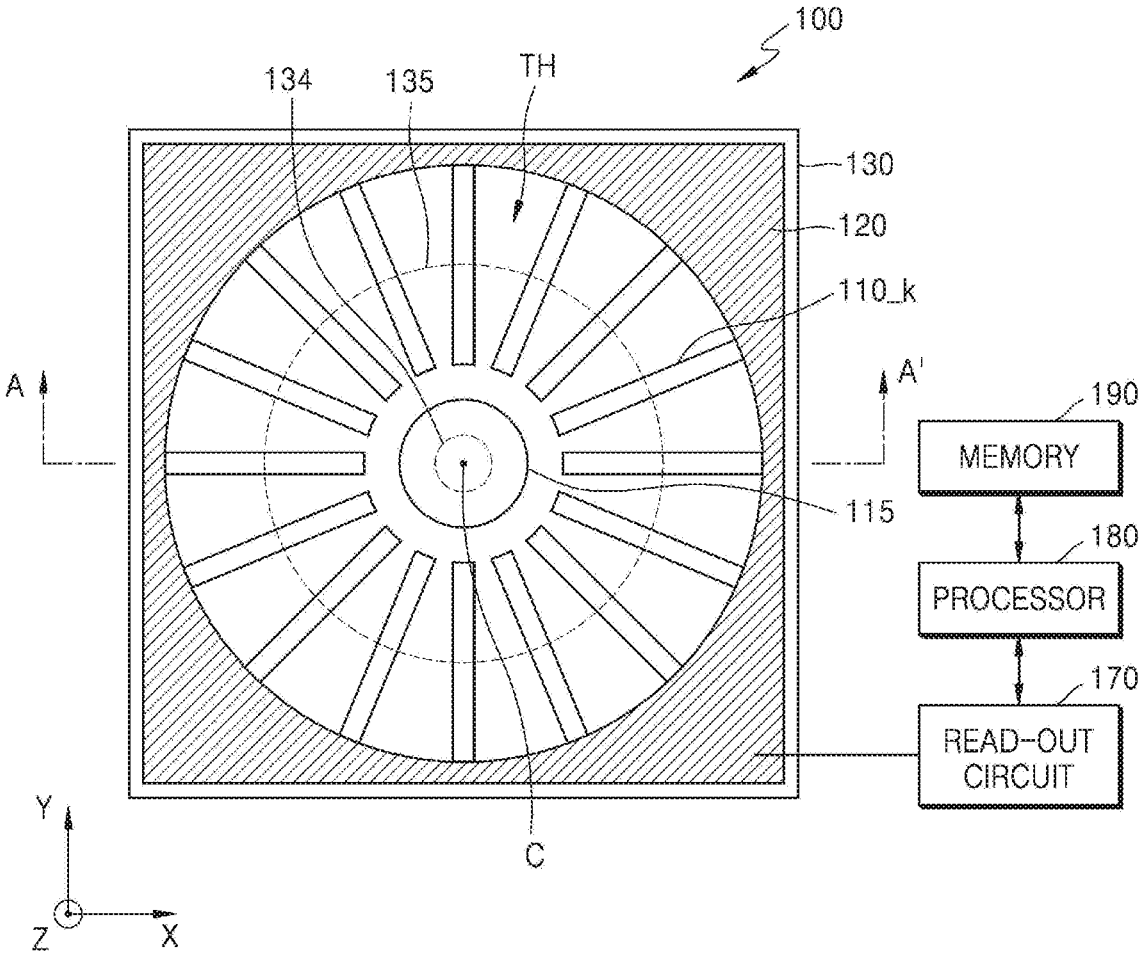
FIG. 1 is a schematic plan view of a spatial audio recording device according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, embodiments are described below by referring to the figures merely to explain aspects. Sizes of components in the drawings may be exaggerated for convenience and clarity of description. Expressions such as "at least one of" and "at least one from among", when preceding a list of elements, modify the entire list of elements and do not modify the individual elements of the list.

It will be understood that, when a component is referred to as being "on" another component, it may be directly or indirectly on the other component.

While such terms as "first" and "second" may be used to describe various components, such components are not limited to the above terms. The above terms are used only to distinguish one component from another. These terms are not intended to imply any difference between materials or structures of components.

As used herein, the singular forms "a," "an," and "the" are intended to include the plural forms as well, unless the context clearly indicates otherwise. It will be further understood that, when a portion "includes" or "comprises" an element, another element may be further included, rather than excluding the existence of the other element, unless otherwise described.

Also, the terms, such as "unit" or "module", used herein refer to a unit that processes at least one function or operation, and the unit may be implemented by hardware or software, or by a combination of hardware and software.

The operations of all methods described herein may be performed in any suitable order unless otherwise indicated herein or clearly indicated otherwise by context. The use of any and all examples, or exemplary language (e.g., "such as") provided herein, is intended merely to better illuminate the spirit and does not pose a limitation on the scope unless otherwise claimed.

Figure 2:
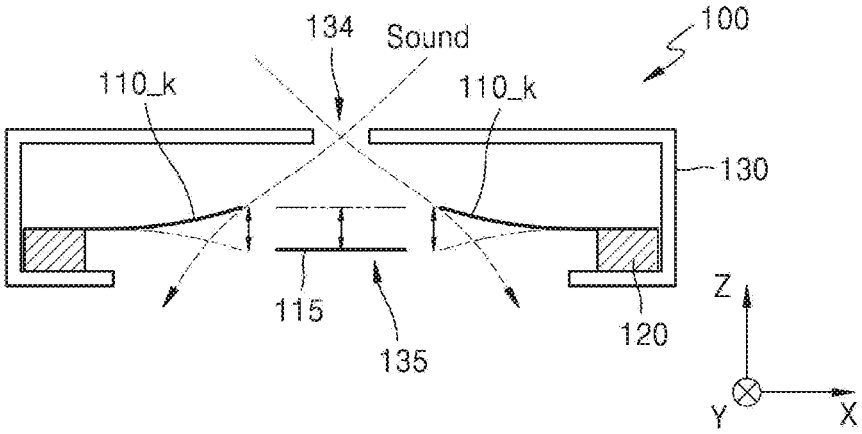
FIG. 2 is a cross-sectional view taken along line AA' of FIG. 1.

FIG. 1 is a schematic plan view of a spatial audio recording device 100 according to an embodiment. FIG. 2 is a cross-sectional view taken along line AA' of FIG. 1.

The spatial audio recording device 100 includes a plurality of directional vibrating bodies 110_*k* arranged so that at least one of the plurality of directional vibrating bodies 110_*k* may selectively react according to a direction of input audio and a non-directional vibrating body 115 which reacts regardless of the direction of input audio. When the number of the plurality of directional vibrating bodies 110_*k* is referred to as N, k is an integer from 1 to N. The spatial audio recording device 100 also includes a read-out circuit 170 which outputs directional audio signals of a plurality of channels and a non-directional audio signal generated in response to the input audio with respect to the plurality of directional vibrating bodies 110_*k* and the non-directional vibrating body 115, respectively, and a processor 180 which corrects the audio signals of a plurality of channels by referring to the non-directional audio signal. The spatial audio recording device 100 may also include a memory 190 in which a code for execution of the processor 180, an execution result of the processor 180, etc. are stored.

As shown in FIG. 2, the plurality of directional vibrating bodies 110_*k* may be arranged between an audio inlet 134 to which audio is input and an audio outlet 135 from which audio input through the audio inlet 134 is discharged. A case 130 including openings corresponding to shapes of the audio inlet 134 and the audio outlet 135 may be used to form the audio inlet 134 and the audio outlet 135. The case 130 may include various materials capable of blocking audio. For example, the case 130 may include a material such as aluminum. The audio inlet 134 and the audio outlet 135 formed in the case 130 are not limited to the shapes shown in FIG. 1.

A supporting portion 120 which supports the plurality of directional vibrating bodies 110_*k* and provides space where the plurality of directional vibrating bodies 110_*k* react to audio and vibrate may be inside the case 130. As shown in FIG. 1, the supporting portion 120 may be formed by forming a through hole TH in a substrate. The plurality of directional vibrating bodies 110_*k* may have one end supported by the supporting portion 120 and may extend into the through hole TH. The through hole TH provides space where the plurality of directional vibrating bodies 110_*k* are free to vibrate due to an external force, and a shape and size of the through hole TH is not particularly limited so long as it is capable of providing such space. The supporting portion 120 may include various materials such as a silicon substrate.

The plurality of directional vibrating bodies 110_*k* are arranged so that one or more may selectively react according to a direction of audio input to the audio inlet 134. The plurality of directional vibrating bodies 110_*k* may surround the audio inlet 134. The plurality of directional vibrating bodies 110_*k* may be coplanar without overlapping each other and may be arranged so that all the plurality of directional vibrating bodies 110_*k* may be exposed with respect to the audio inlet 134. In other words, each of the plurality of directional vibrating bodies 110_*k* may be affected by sound passing through the audio inlet 134 in at least one direction. As shown in FIG. 1, the plurality of directional vibrating bodies 110_*k* may be arranged on the same plane. In addition, the plurality of directional vibrating bodies 110_*k* may surround a central point C on the plane, the central point C vertically facing a center of the non-directional vibrating body 115. In other words, the center of the non-directional vibrating body 115 may be located directly above or below the central point C in a direction perpendicular to the plane of the directional vibrating bodies 110_*k*. Although FIG. 1 shows the plurality of directional vibrating bodies 110_*k* surrounding the central point C in a circular form, this is merely an example. Arrangement of the plurality of directional vibrating bodies 110_*k* is not limited thereto, and the plurality of directional vibrating bodies 110_*k* may be arranged to have various forms having certain symmetry with respect to the central point C. For example, the plurality of directional vibrating bodies 110_*k* may be arranged to form a polygonal or oval shape around the central point C.

The audio outlet 135 may face all of the plurality of directional vibrating bodies 110_*k*. A size of the audio outlet 135 shown is an example, and a size of the audio outlet 135 may be different from the size of the audio outlet 135 shown. Sizes or shapes of the audio inlet 134 and the audio outlet 135 are not particularly limited, and the audio inlet 134 and the audio outlet 135 may have any size and shape sufficient to expose the plurality of directional vibrating bodies 110_*k* to the same extent.

For example, the non-directional vibrating body 115 may be located within the boundary of the audio outlet 135 and may be on the same plane as the plurality of directional vibrating bodies 110_*k*. However, the disclosure is not limited thereto, and the non-directional vibrating body 115 may be on a different plane. As shown, the plurality of directional vibrating bodies 110_*k* may surround the non-directional vibrating body 115. However, a location of the non-directional vibrating body 115 is not limited thereto, and the non-directional vibrating body 115 may be at other various locations. For example, the non-directional vibrating body 115 may be outside the case 130.

Unlike the plurality of directional vibrating bodies 110_*k*, the non-directional vibrating body 115 may have the same output or almost the same output with respect to audio input from every direction. To this end, the non-directional vibrating body 115 may have the form of a circular thin film. When the non-directional vibrating body 115 is within the boundary of the audio outlet 135, a center of the non-directional vibrating body 115 having a circular shape may coincide with a central point of the audio outlet 135.

Physical angle resolution, that is, accuracy of detecting the traveling direction of incident audio, of the spatial audio recording device 100 may be determined by a number N of the plurality of directional vibrating bodies 110_*k*. The spatial audio recording device 100 may detect a direction of incident sound by comparing respective sizes of output signals of the plurality of directional vibrating bodies 110_*k* and as the number of the plurality of directional vibrating bodies 110_*k* to be compared with each other increases, the traveling direction of incident audio may be more precisely determined.

Sensitivity resolution where the plurality of directional vibrating bodies 110_*k* each sense audio may be determined by a circuit element that converts such vibrational movement into an electrical signal when the plurality of directional vibrating bodies 110_*k* react to an external force and move (i.e., vibrate). To increase resolution, a more complex and fine circuit element is required, and as the number of the plurality of directional vibrating bodies 110_*k*, that is, N, increases, complexity of a system increases. Such circuit elements may be included in the read-out circuit 170. Although the read-out circuit 170 is shown with a block diagram in the drawing, in order to read signals received in the plurality of directional vibrating bodies 110_*k* and the non-directional vibrating body 115, individual circuit elements constituting the read-out circuit 170 may be electrically connected to each one of the plurality of directional vibrating bodies 110_*k* and to the non-directional vibrating body 115, respectively, and may be arranged inside the case 130. As a system becomes complex with a demand for a fine circuit element, a volume of the spatial audio recording device 100 increases, and power consumption also increases.

The spatial audio recording device 100 according to an embodiment may set resolution of the plurality of directional vibrating bodies 110_*k* to be lower than that of the non-directional vibrating body 115. As described above, increasing resolution of the plurality of directional vibrating bodies 110_*k* involves increasing a volume of the overall system, complexity, and power consumption. To more efficiently increase resolution where the spatial audio recording device 100 senses audio, the non-directional vibrating body 115 may be allowed to have high resolution and the plurality of directional vibrating bodies 110_*k* may be allowed to have relatively low resolution. For example, resolution of the plurality of directional vibrating bodies 110_*k* may be equal to or lower than 1/10 of resolution of the non-directional vibrating body 115. The processor 180 of the spatial audio recording device 100 may correct an output signal of the plurality of directional vibrating bodies 110_*k* of such low resolution so as to approach the original audio by using an output signal of the non-directional vibrating body 115.

A spatial audio recording method according to an embodiment will now be described in detail with reference to FIGS. 3 to 8D. The method that will be described may be performed by the spatial audio recording device 100 of FIG. 1. However, the disclosure is not limited thereto, and the method may be performed by a spatial audio recording device of different configurations including a directional vibrating body and a non-directional vibrating body.

Figure 3:
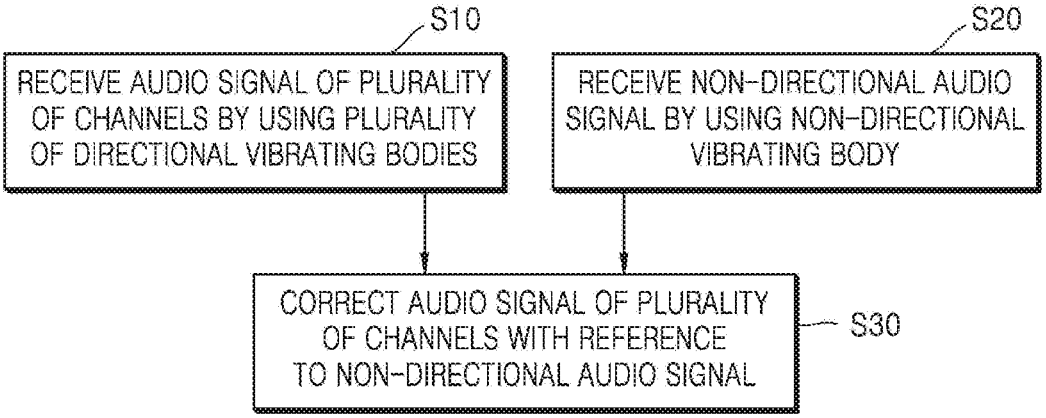
FIG. 3 is a schematic flowchart of a spatial audio recording method according to an embodiment.
Figure 4:
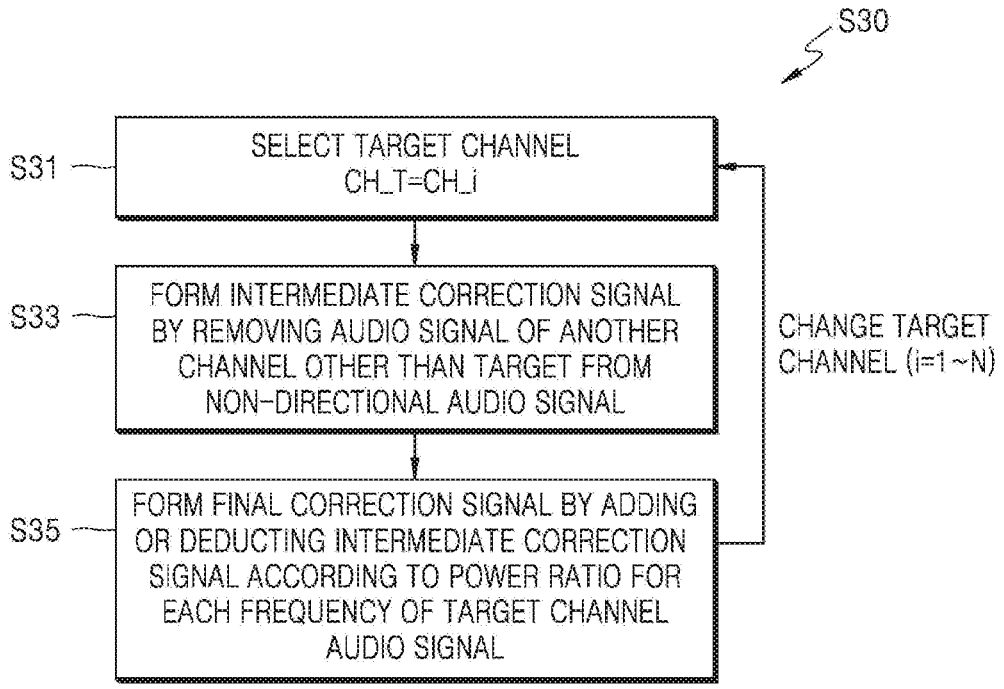
FIG. 4 is a detailed flowchart of a process of correcting an audio signal of a plurality of channels in the flowchart of FIG. 3.

FIG. 3 is a schematic flowchart of a spatial audio recording method according to an embodiment. FIG. 4 is a detailed flowchart of a process of correcting an audio signal of a plurality of channels in the flowchart of FIG. 3.

Referring to FIG. 3, a spatial audio recording method according to an embodiment includes an operation of receiving a directional audio signal including a plurality of channels by using a plurality of directional vibrating bodies (S10) and an operation of receiving a non-directional audio signal by using a non-directional vibrating body (S20). Such a process may be performed by using a sensor including a plurality of directional vibrating bodies and a non-directional vibrating body, and the plurality of directional vibrating bodies and the non-directional vibrating body are not limited to configurations of a spatial audio recording device shown in FIG. 1. The directional audio signal including a plurality of channels refers to audio information which is input from different directions and received in the plurality of directional vibrating bodies.

Next, the directional audio signal of a plurality of channels is corrected with reference to the non-directional audio signal (S30). The directional audio signal may be a signal that has low resolution compared to the non-directional audio signal. Multiple directional vibrating bodies, that is, as many directional vibrating bodies as possible, are provided to obtain directional nature, and thus, when all of the directional vibrating bodies are allowed to have high resolution, complexity of system and power consumption may increase significantly. Accordingly, a spatial audio recording method according to an embodiment involves correcting a directional audio signal with relatively low resolution by referring to a non-directional audio signal obtained at relatively high resolution.

Referring to FIG. 4, describing the process of correcting a directional audio signal (S30) in detail, a target channel CH_T (i.e., a first channel) targeted for correction is selected first (S31). A plurality of directional audio signals may be obtained by a plurality of vibrating bodies according to a form where a sound source is distributed over space, and since all the plurality of directional audio signals are audio signals of low resolution, the plurality of directional audio signals are successively targeted for correction so as to approach the original audio. That is, such audio signals are sequentially selected as a target channel.

Next, an intermediate correction signal is formed by removing an audio signal of another channel (i.e., a second channel) other than the target channel from the non-directional audio signal (S33). When there is more than one audio signal of another channel, all other audio signals may be used to form the intermediate correction signal.

Next, a final correction signal is formed by adding or deducting the intermediate correction signal according to a power ratio for each frequency of a target channel audio signal (S35).

The above process of forming an intermediate correction signal and forming a final correction signal to reconstruct an audio signal of a target channel from a non-directional audio signal of high resolution will now be described by illustrating an example directional audio signal graph and non-directional audio signal graph.

Figure 5A:
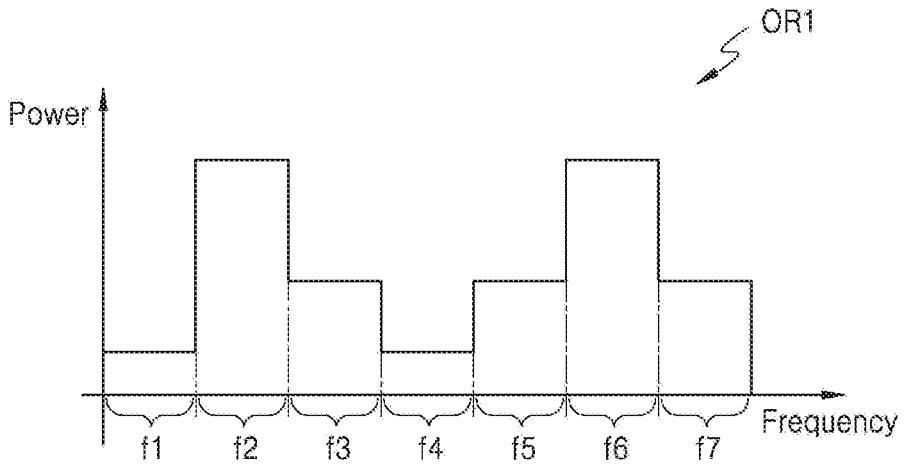
FIGS. 5A and 5B are graphs showing first original audio input from a first direction and a signal having the first original audio received in a directional vibrating body of a channel corresponding to the first direction.
Figure 5B:
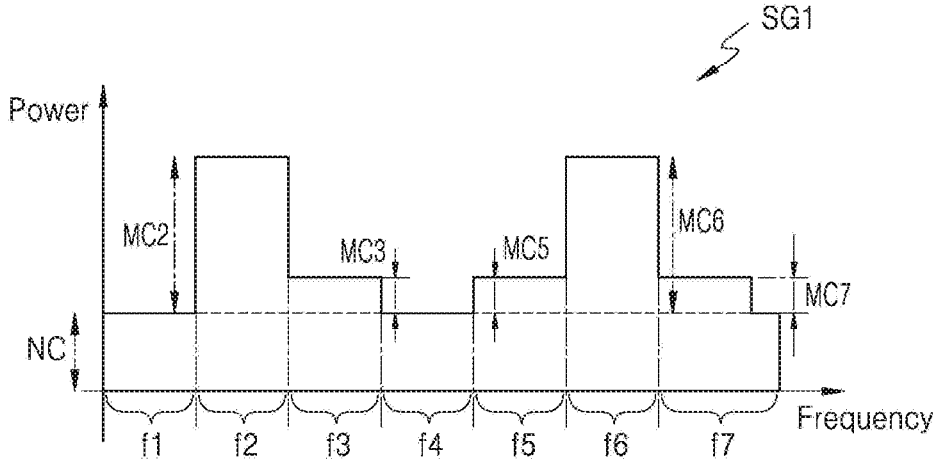

FIGS. 5A and 5B are graphs showing first original audio input from a first direction and a signal having the first original audio received in a directional vibrating body of a channel corresponding to the first direction.

First original audio OR1 shown in FIG. 5A is sensed in the form of a first signal SG1 by a directional vibrating body as shown in FIG. 5B. The first signal SG1 does not have the same signal value (power) for each frequency band as the first original audio OR1, and this is because it is difficult to distinguish between a noise component and original audio in a region having a low signal value due to low resolution of the directional vibrating body. Referring to the graph, the first signal SG1 includes major components MC2, MC3, MC5, MC6, and MC7 which have different signal powers and which each correspond to a respective frequency band and a minor component NC which has no difference in signal power for each frequency band. In other words, the minor component NC corresponds to those frequency bands of the original audio OR1 that do not have a strong enough signal to cause a measurable difference in signal power. The minor component NC may include both a small signal value included in the first original audio OR1 and noise. As shown in FIG. 5B, the major components MC2, MC3, MC5, MC6, and MC7 are denoted by signal values excluding the minor component NC in frequency bands f2, f3, f5, f6, and f7, respectively.

Figure 6A:
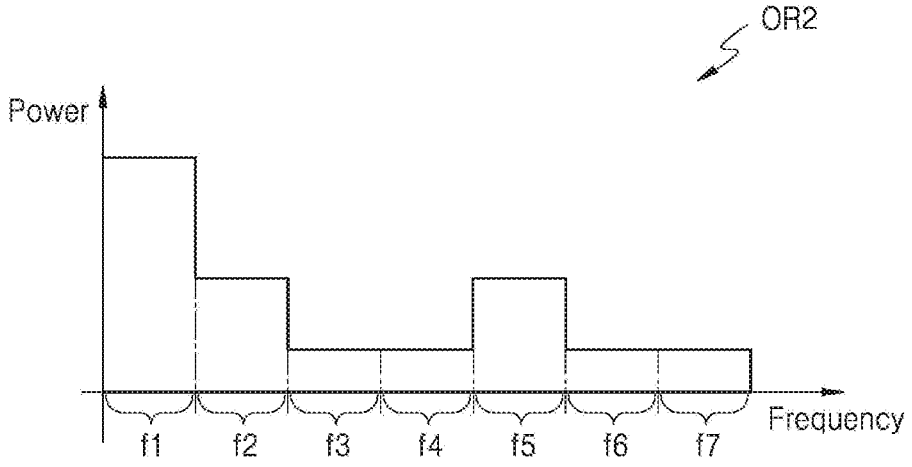
FIGS. 6A and 6B are graphs showing second original audio input from a second direction and a signal having the second original audio received in a directional vibrating body of a channel corresponding to the second direction.
Figure 6B:
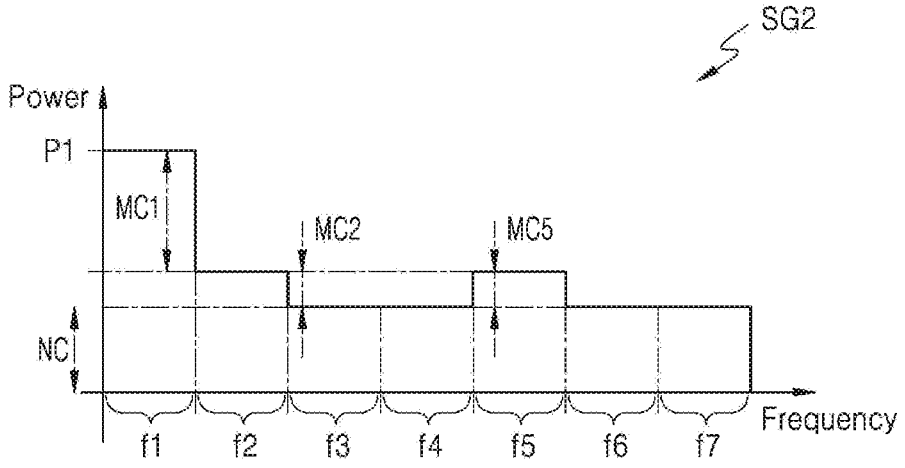

FIGS. 6A and 6B are graphs showing second original audio input from a second direction and a signal having the second original audio received in a directional vibrating body of a channel corresponding to the second direction.

Second original audio OR2 shown in FIG. 6A is sensed in the form of a second signal SG2 by a directional vibrating body as shown in FIG. 6B. The second signal SG2 also does not have the same signal value (power) for each frequency band as the second original audio OR2, and this is because it is difficult to distinguish between a noise component and original audio in a region having a low signal value due to low resolution of the directional vibrating body. Referring to the graph, the second signal SG2 includes major components MC1, MC2, and MC5 which have different signal powers and which correspond to a respective frequency band and a minor component NC which has no difference in signal power among frequency bands. The minor component NC may include both a small signal value included in the second original audio OR2 and noise. The major components MC1, MC2, and MC5 are denoted by signal values excluding the minor component NC in frequency bands f1, f2, and f5, respectively.

Figure 7:
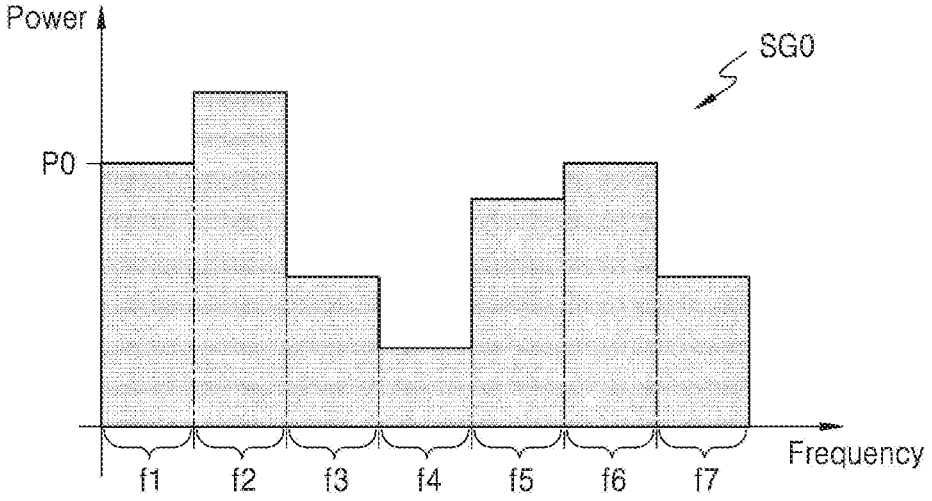
FIG. 7 is a graph showing a signal having audio received in a non-directional vibrating body, the audio having the first original audio and the second original audio mixed together.

FIG. 7 is a graph showing a signal of audio received in a non-directional vibrating body, the audio having the first original audio and the second original audio mixed together.

A mixed signal SG0 is a signal where audio from every direction is mixed together and directional nature thereof is not distinguished by a non-directional vibrating body, and is a signal that has high resolution compared to the first signal SG1 and the second signal SG2 having directional nature.

The first signal SG1 and the second signal SG2 of FIGS. 5B and 6B may be corrected so as to be close to the original by using the mixed signal SG0 of high resolution, and a case of selecting the second signal SG2 of FIG. 6B as a target channel to be reconstructed and correcting the second signal SG2 will be described below.

Figure 8A:
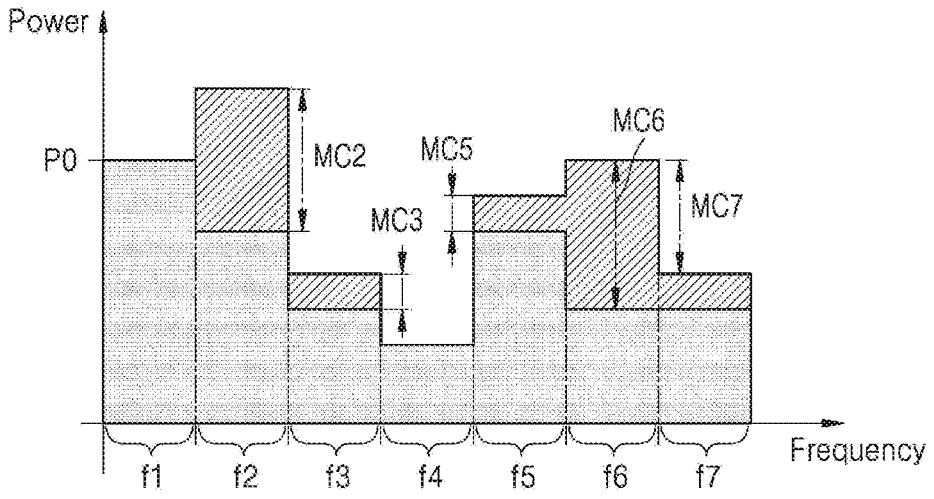
FIGS. 8A, 8B, 8C, and 8D are graphs showing, step by step, a process of reconstructing audio of a target channel from the graph of FIG. 7.
Figure 8B:
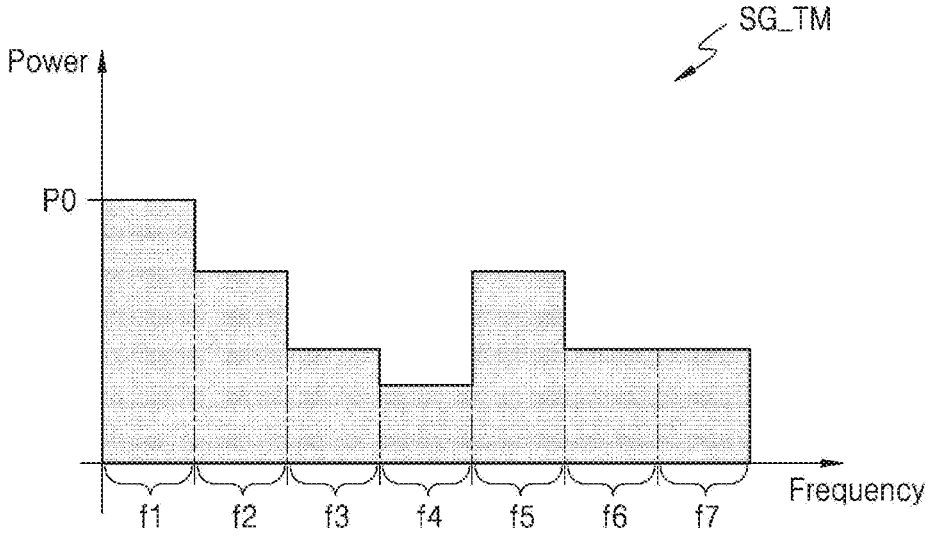

FIGS. 8A and 8B are graphs showing, step by step, a process of reconstructing audio of a target channel from the graph of FIG. 7.

Referring to FIGS. 8A and 8B, an intermediate correction signal SG_TM is formed by removing a major component of the first signal SG1 of FIG. 6A from the mixed signal SG0 of FIG. 7. The major components MC2, MC3, MC5, MC6, and MC7 shown in FIG. 6A are deducted from corresponding frequency bands f2, f3, f5, f6, and f7 of the mixed signal SG0 to form the intermediate correction signal SG_TM as shown in FIG. 8B.

In the description, a channel of the second signal SG2 is a target channel and an example of a signal of another channel other than the target channel is the first signal SG1. However, signals for more channels than the single first signal SG1 may be considered. In such a case, the intermediate correction signal SG_TM may be extracted by deducting all major components of signals of a plurality of other channels.

Figure 8C:
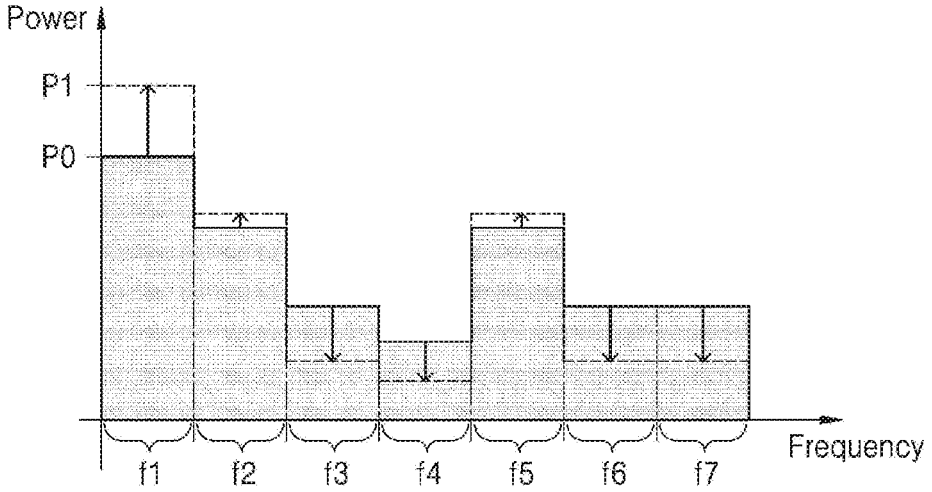
Figure 8D:
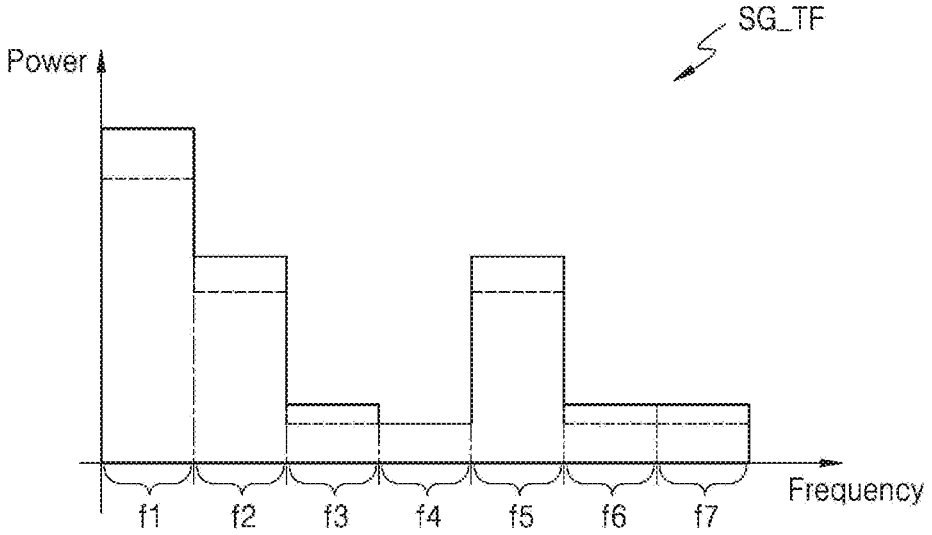

Referring to FIGS. 8C and 8D, a final correction signal SG_TF is formed from the intermediate correction signal SG_TM of FIG. 8B.

The second signal SG2 of FIG. 6B selected as a signal of a target channel is used to form the final correction signal SG_TF. As described above with reference to FIG. 6B, a frequency band of the second signal SG2 of the target channel includes a major frequency band which has different signal powers for each frequency band and a minor frequency band which has no difference in signal power for each frequency band. In other words, frequency bands f1, f2, and f5 are major frequency bands and f3, f4, f6, and f7 are minor frequency bands. Signal values in the frequency bands of the intermediate correction signal SG_TM shown in FIG. 8B may be added or deducted so that a ratio of signal values in major frequency bands of the second signal SG2 can be maintained.

In other words, signal values of frequency bands f1, f2, and f5 in the intermediate correction signal SG_TM are adjusted to match a relative ratio of signal values in frequency bands f1, f2, and f5 of the second signal SG2. To this end, initially, a signal value P0 of the frequency band f1 may be amplified to match a signal value P1 of the frequency band f1 of the second signal SG2.

Next, based on the above correction, signal values of frequency bands f2 and f5 may be corrected to match a ratio of a signal value in the frequency band f1, a signal value in the frequency band f2, and a signal value in the frequency band f5 with a ratio in the frequency bands of the second signal SG2 of FIG. 6B, that is, (NC+MC1):(NC+MC2):(NC+MC5).

Signal values of the minor frequency bands f3, f4, f6, and f7 may be reduced by half. Such deduction correction is performed because a signal value of a minor frequency band includes a minor component and a noise component of an audio signal of another channel other than the target channel. However, a decrease by half is an example, and a decrease by another proportion is also possible.

FIG. 8D shows a signal value of the second original audio of FIG. 6A with dashed lines, in addition to showing the final correction signal SG_TF with solid lines. The final correction signal SG_TF includes a minor component of another channel other than a target channel and thus displays a region having a signal value higher than that of the second original audio. The final correction signal SG_TF is a corrected second signal SG2 and has increased accuracy compared to the second signal SG2 of FIG. 6A.

According to the above method, it is possible to correct the second signal SG2 of relatively low resolution, which has directional nature, so as to be close to original audio by using the mixed signal SG0 of high resolution, which has no directional nature, and the first signal SG1 having different directional nature.

In the above description, setting the second signal SG2 as a target channel is given as an example, and the first signal SG1 may be set as a target channel and be corrected so as to approach the original audio through similar processes.

In the above description, directional audio signals of two channels, that is, the first signal SG1 and the second signal SG2, are given as an example. However, the disclosure is not limited thereto. For example, when audio signals of a plurality of three or more channels are obtained, a process of forming a final correction signal may be repeated by successively selecting all of the plurality of channels as a target channel one by one. Accordingly, every directional nature included in original audio may be estimated, and a related audio signal may be corrected so as to approach the original audio.

Figure 9:
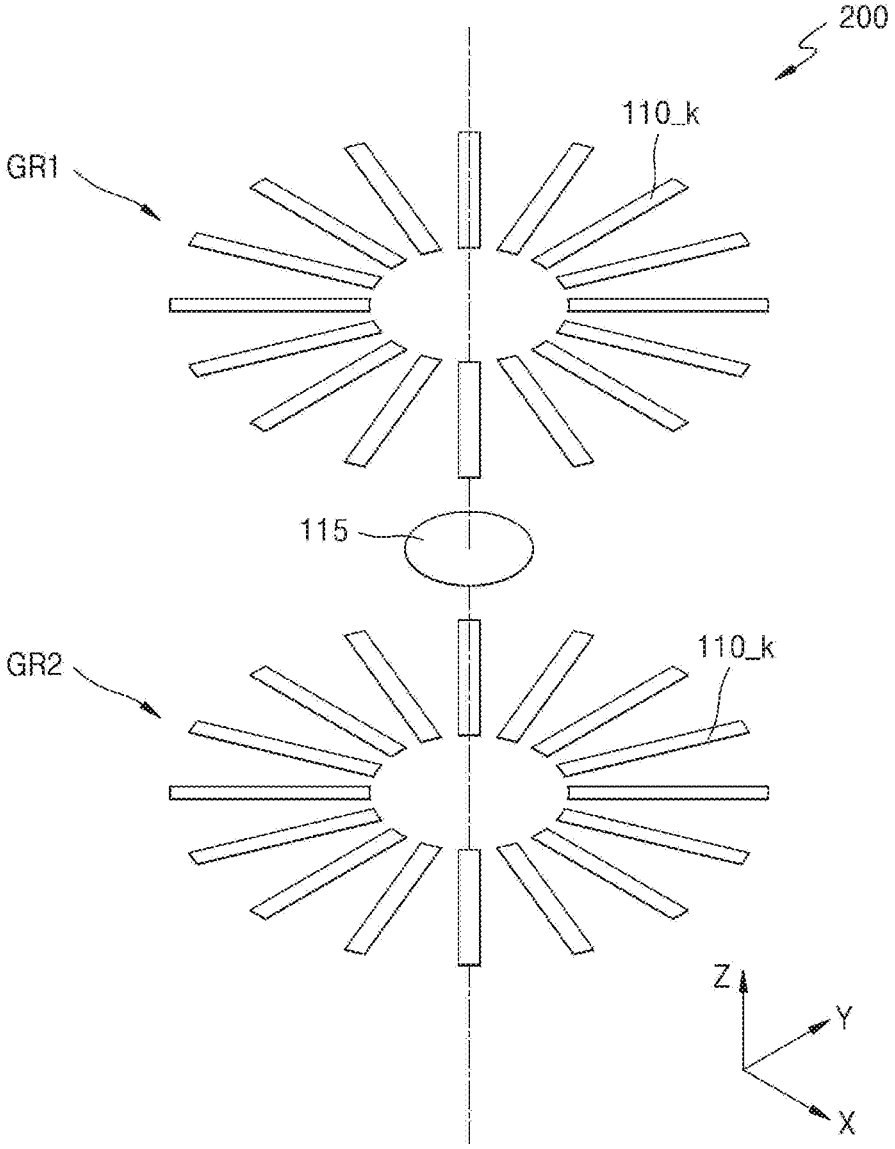
FIG. 9 is a perspective view of an example of arrangement of vibrating bodies of a spatial audio recording device according to an embodiment.

FIG. 9 is a perspective view of an example arrangement of vibrating bodies of a spatial audio recording device 200 according to an embodiment.

The spatial audio recording device 200 may have substantially the same configurations as the spatial audio recording device 100 of FIG. 1 except for the arrangement of the plurality of directional vibrating bodies 110_*k*.

The plurality of directional vibrating bodies 110_*k* may be arranged on a plurality of planes located at the same distance from the non-directional vibrating body 115. As shown, the plurality of directional vibrating bodies 110_*k* may be arranged on two planes spaced parallel to each other with the non-directional vibrating body 115 located therebetween. That is, some of the plurality of directional vibrating bodies 110_*k* may be arranged on a plane parallel to the XY plane of FIG. 9 to form a first group GR1, and the others may be arranged on a different plane parallel to the XY plane to form a second group GR2.

Figure 10:
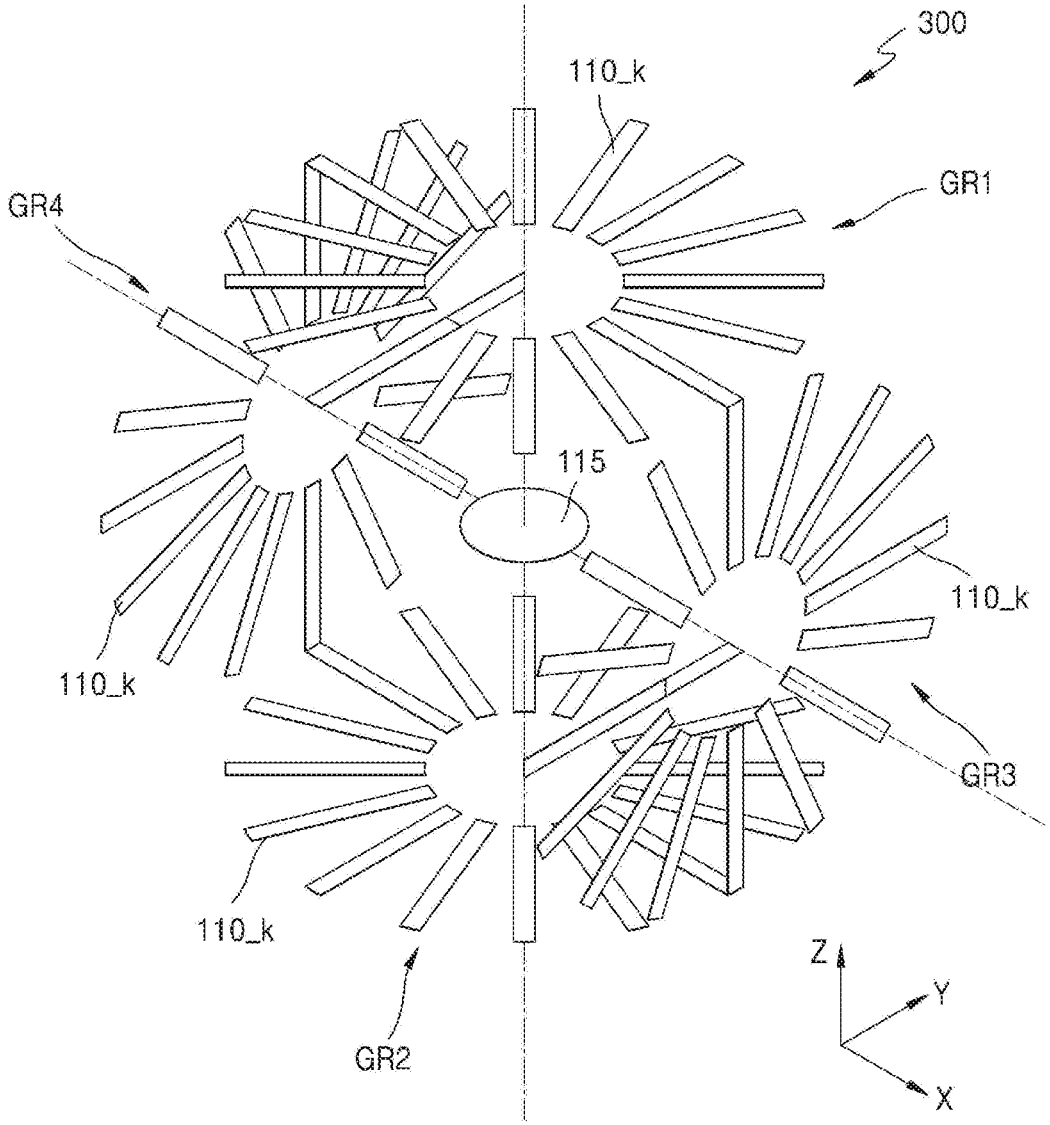
FIG. 10 is a perspective view of an example of arrangement of vibrating bodies of a spatial audio recording device according to an embodiment.

FIG. 10 is a perspective view of an example arrangement of vibrating bodies of a spatial audio recording device 300 according to an embodiment.

The spatial audio recording device 300 is different from the spatial audio recording device 200 of FIG. 9 in that additional groups GR3 and GR4 of directional vibrating bodies 110_*k* are arranged parallel to the YZ plane in addition to the two planes parallel to the XY plane.

The plurality of directional vibrating bodies 110_*k* may be divided into the first group GR1, the second group GR2, the third group GR3, and the fourth group GR4. The first group GR1 and the second group GR2 may be respectively located on two planes parallel to the XY plane, and the third group GR3 and the fourth group GR4 may be respectively located on two planes parallel to the YZ plane.

In some embodiments, the plurality of directional vibrating bodies 110_*k* may be arranged on two planes parallel to the XY plane, two planes parallel to the YZ plane, and two planes parallel to the XZ plane with the non-directional vibrating body 115 at the center.

A spatial audio recording device according to the previous embodiments may be used in various electronic apparatuses. The spatial audio recording device may be realized as a sensor in the form of a chip to perform sound source tracking, noise removal, spatial recording, etc. in the field of mobile devices, information technology (IT), household appliances, automobiles, etc. and may also be used in the field of panoramic exposure, augmented reality (AR), virtual reality (VR), etc.

Electronic apparatuses using a spatial audio recording device according to an embodiment will now be described.

Figure 11:
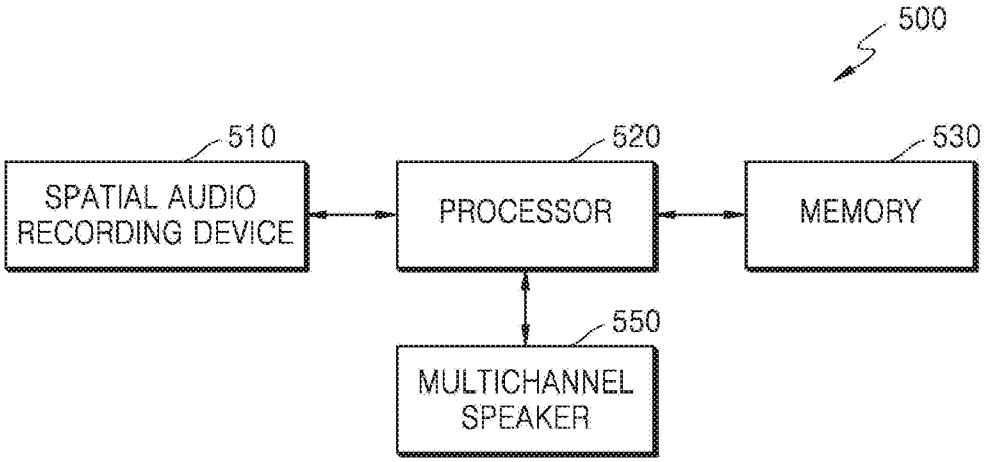
FIG. 11 is a schematic block diagram of an electronic apparatus according to an embodiment.

FIG. 11 is a schematic block diagram of an electronic apparatus 500 according to an embodiment.

The electronic apparatus 500 is a spatial audio recording/reproduction apparatus.

The electronic apparatus 500 includes a spatial audio recording device 510 and a multichannel speaker 550 for reproducing recorded audio in accordance with directional nature. The electronic apparatus 500 may also include a memory 530 for storing a signal sensed and corrected in the spatial audio recording device 510, and a processor 520 for controlling the multichannel speaker 550 to reproduce an audio signal stored in the memory 530 in accordance with directional nature.

Any one of the spatial audio recording devices 100, 200, and 300 according to previous embodiments or a modified and combined structure thereof may be used as the spatial audio recording device 510. As described above, the spatial audio recording device 510 may estimate directional nature of surrounding audio and may correct a sensed audio signal so as to be close to original audio.

The memory 530 may store a program for signal processing of the processor 520 and may store an execution result of the processor 520. In addition, the memory 530 may store various programs and pieces of data required for the processor 520 to control an overall operation of the electronic apparatus 500.

The memory 530 may include at least one type of storage medium from among flash memory type memory, hard disk type memory, multimedia card micro type memory, card type memory (e.g., secure digital (SD) or extreme digital (XD) memory, etc.), random access memory (RAM), static random access memory (SRAM), read-only memory (ROM), electrically erasable programmable read-only memory (EEPROM), programmable read-only memory (PROM), magnetic memory, magnetic disk, and optical disk.

The electronic apparatus 500 may perform recording focused on an intended sound source or may selectively record only an intended sound source by using a result of estimating an input direction of audio.

The electronic apparatus 500 may sense, correct, and record directional audio and reproduce a recorded sound source in accordance with directional nature and thus may augment realism of content and improve level of immersion and feeling of reality.

The electronic apparatus 500 may be used in an AR or VR apparatus.

Figure 12:
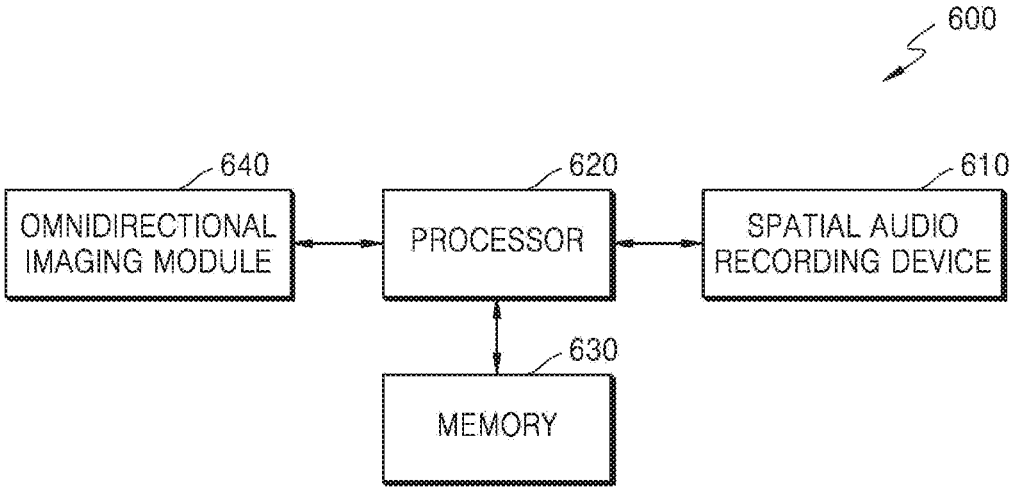
FIG. 12 is a schematic block diagram of an electronic apparatus according to an embodiment.

FIG. 12 is a schematic block diagram of an electronic apparatus 600 according to another embodiment.

The electronic apparatus 600 is an omnidirectional camera capable of performing panoramic exposure on an object placed in any direction. The electronic apparatus 600 includes a spatial audio recording device 610, an omnidirectional imaging module 640, a processor 620 for controlling the spatial audio recording device 610 and the omnidirectional imaging module 640 to match a directional audio signal sensed in the spatial audio recording device 610 with an omnidirectional image signal captured in the omnidirectional imaging module 640, and a memory 630 for storing the directional audio signal and the omnidirectional image signal.

A general panoramic exposure module may be used as the omnidirectional imaging module 640, and for example, a form including configurations of optical lenses and an image sensor in a 360-degree rotatable main body may be used.

The spatial audio recording device 610 may be any one of the spatial audio recording devices 100, 200, and 300 according to previous embodiments or may have a modified and combined structure thereof. As described above, the spatial audio recording device 610 may estimate directional nature of surrounding audio and may correct a sensed audio signal so as to approach the original audio.

According to control of the processor 620, from among signals sensed in the spatial audio recording device 610, audio of a direction corresponding to a capturing direction of the omnidirectional imaging module 640 may be selectively stored in the memory 630. As described above, a 360° panoramic image signal and an audio signal matching the panoramic image may be stored in the memory 630 by the electronic apparatus 600. Such image/audio information may be reproduced by a display apparatus including a multichannel speaker and may maximize realism and may also be used in an AR/VR apparatus.

Electronic apparatuses described herein may include a processor, a memory for storing and executing program data, a permanent storage unit such as a disk drive, a communication port for communicating with an external apparatus, and a user interface apparatus such as a touch panel, a key, a button, etc.

Methods implemented by software modules or algorithms in electronic apparatuses described herein may be stored as program instructions or computer-readable codes executable on the processor on a computer-readable medium. Examples of the computer-readable recording medium include magnetic storage media (e.g., ROM, RAM, floppy disk, hard disk, etc.) and optical recording media (e.g., CD-ROM, DVD, etc.). The computer-readable recording medium may also be distributed over network-coupled computer systems so that the computer-readable code is stored and executed in a distributive manner. This medium may be read by the computer, stored in the memory, and executed by the processor.

According to one or more embodiments, a spatial audio recording device and method make it possible to sense and record spatial audio with low power consumption by using a non-directional vibrating body and a plurality of directional vibrating bodies.

According to one or more embodiments, a spatial audio recording device may be used in various electronic apparatuses that may utilize the sensed spatial audio.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A spatial audio recording device comprising:

a plurality of directional vibrating bodies arranged such that at least one directional vibrating body from among the plurality of directional vibrating bodies selectively reacts according to a direction of input audio;

a non-directional vibrating body configured to react regardless of the direction of the input audio;

a read-out circuit configured to output a directional audio signal based on reactions of the plurality of directional vibrating bodies and a non-directional audio signal based on a reaction of the non-directional vibrating body; and a processor configured to process the directional audio signal and the non-directional audio signal.

2. The spatial audio recording device of claim 1, wherein a resolution of the plurality of directional vibrating bodies is lower than a resolution of the non-directional vibrating body.

3. The spatial audio recording device of claim 1, wherein the directional audio signal includes a plurality of channels and the processor is further configured to:

select a first channel from among the plurality of channels;

form an intermediate correction signal by removing a directional audio signal of at least one second channel from the non-directional audio signal;

compute a ratio of signal powers of frequency bands of a directional audio signal of the first channel; and form a final correction signal by adding or deducting signal power for each frequency band of the intermediate correction signal to correspond to the computed ratio.

4. The spatial audio recording device of claim 3, wherein the at least one second channel comprises a plurality of second channels, and wherein the processor is further configured to form the intermediate correction signal by removing every directional audio signal of the plurality of second channels from the non- directional audio signal.

5. The spatial audio recording device of claim 3, wherein the directional audio signal of the at least one second channel comprises a major component including frequency bands having different signal powers and a minor component including frequency bands having a same signal power, and wherein the processor is further configured to form the intermediate correction signal by removing the major component from the non-directional audio signal.

6. The spatial audio recording device of claim 3, wherein the directional audio signal of the first channel comprises a major component including frequency bands having different signal powers and a minor component including frequency bands having a same signal power, and wherein the processor is further configured to form the final correction signal by adding or deducting respective signal powers of frequency bands of the major component to correspond to the computed ratio.

7. The spatial audio recording device of claim 6, wherein the processor is further configured to decrease the signal power of the frequency bands of the minor component by half to form the final correction signal.

8. The spatial audio recording device of claim 1, wherein, for each channel from among a plurality of channels of the directional audio signal, the processor is further configured to:

form an intermediate correction signal by removing a directional audio signal of at least one other channel from the non-directional audio signal;

compute a ratio of signal powers of frequency bands of a directional audio signal of the respective channel; and form a final correction signal by adding or deducting signal power for each frequency band of the intermediate correction signal according to the ratio.

9. The spatial audio recording device of claim 1, wherein the plurality of directional vibrating bodies are arranged on a same plane to surround a central point on the plane, and wherein a center of the non-directional vibrating body is located directly above the central point in a direction perpendicular to the plane.

10. The spatial audio recording device of claim 1, wherein the plurality of directional vibrating bodies are arranged on a plurality of planes, each plane from among the plurality of planes being located at a same distance from the non-directional vibrating body.

11. The spatial audio recording device of claim 10, wherein the plurality of planes comprise a first plane and a second plane parallel to each other.

12. The spatial audio recording device of claim 11, wherein the plurality of planes further comprise a third plane and a fourth plane perpendicular to the first plane and the second plane, the third plane and the fourth plane being parallel to each other.

13. The spatial audio recording device of claim 12, wherein the plurality of planes further comprise a fifth plane and a sixth plane perpendicular to the first plane, the second plane, the third plane, and the fourth plane, the fifth plane and the sixth plane being parallel to each other.

14. An electronic apparatus comprising the spatial audio recording device of claim 1.

15. The electronic apparatus of claim 14, further comprising:

a multichannel speaker configured to reproduce a corrected audio signal based on the processed directional audio signal.

16. The electronic apparatus of claim 14, further comprising:

an omnidirectional imaging module configured to capture an image in a plurality of directions corresponding to a plurality of channels of the directional audio signal.

17. A spatial audio recording method comprising:

receiving a directional audio signal including a plurality of channels each corresponding to a different direction of the input audio;

receiving a non-directional audio signal; and processing the directional audio signal and the non-directional audio signal, wherein the processing the directional audio signal and the non-directional audio signal comprises:

selecting a first channel from among the plurality of channels;

forming an intermediate correction signal by removing a directional audio signal of at least one second channel from the non-directional audio signal;

computing a ratio of signal powers of frequency bands of a directional audio signal of the first channel; and forming a final correction signal by adding or deducting signal power for each frequency band of the intermediate correction signal to correspond to the ratio.

18. The spatial audio recording method of claim 17, wherein the at least one second channel comprises a plurality of second channels, and the forming the intermediate correction signal comprises removing every directional audio signal of the plurality of second channels from the non-directional audio signal.

19. The spatial audio recording method of claim 17, wherein the directional audio signal of the at least one second channel comprises a major component including frequency bands having different signal powers and a minor component including frequency bands having a same signal power, and wherein the forming of the intermediate correction signal comprises removing the major component from the non-directional audio signal.

20. The spatial audio recording method of claim 17, wherein the directional audio signal of the first channel comprises a major component including frequency bands having different signal powers and a minor component including frequency bands having a same signal power, and wherein the forming of the final correction signal comprises adding or deducting respective signal powers of frequency bands of the major component to correspond to the computed ratio.

21. A spatial audio recording method comprising:

receiving a directional audio signal including a plurality of channels each corresponding to a different direction of the input audio;

receiving a non-directional audio signal;

processing the directional audio signal and the non-directional audio signal;

providing a plurality of directional vibrating bodies arranged such that at least one directional vibrating body from among the plurality of directional vibrating bodies selectively reacts according to a direction of input audio; and providing a non-directional vibrating body configured to react regardless of the direction of the input audio, wherein the directional audio signal is received from the plurality of directional vibrating bodies, and wherein the non-directional audio signal is received from the non-directional vibrating body.

* * * * *